US011988129B2

(12) United States Patent
Zhang et al.

(10) Patent No.: US 11,988,129 B2
(45) Date of Patent: May 21, 2024

(54) METHOD FOR OPERATING A FUEL-OPERATED BURNER

(71) Applicant: Robert Bosch GmbH, Stuttgart (DE)

(72) Inventors: Chao Zhang, Beilstein (DE); Dietmar Uhlenbrock, Stuttgart (DE); Erwin Schiele, Flein (DE); Winfried Langer, Illingen (DE); Markus Deissler, Heilbronn (DE); Michael Nau, Dornhan/Aischfeld (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/170,311

(22) Filed: Feb. 16, 2023

(65) Prior Publication Data

US 2023/0258116 A1 Aug. 17, 2023

(30) Foreign Application Priority Data

Feb. 17, 2022 (DE) ..... 10 2022 201 645.9

(51) Int. Cl.
*F01N 3/20* (2006.01)

(52) U.S. Cl.
CPC ..... *F01N 3/2033* (2013.01)

(58) Field of Classification Search
CPC ..... F01N 3/2033; F01N 3/025; F01N 9/00; F01N 3/38; F01N 3/36
See application file for complete search history.

(56) References Cited

U.S. PATENT DOCUMENTS 5,617,720 A * 4/1997 Achleitner ..... F01N 3/2033 60/284

FOREIGN PATENT DOCUMENTS

| | | | |
|---|---|---|---|
| DE | 2219371 | A1 | 2/1973 |
| DE | 4132814 | A1 | 4/1993 |
| DE | 19504208 | A1 | 8/1995 |
| DE | 4430965 | A1 | 3/1996 |

* cited by examiner

*Primary Examiner* — Anthony Ayala Delgado
(74) *Attorney, Agent, or Firm* — Michael Best & Friedrich LLP

(57) ABSTRACT

A method for operating a fuel-operated burner (3) downstream of an engine (1) and upstream of a catalytic converter (4), comprising an actuation of an ignition apparatus (12) of the burner (3) during a pre-definable preheating phase, without delivering fuel (11) to the burner (3) during the preheating phase, and, after the end of the preheating phase, a timely delivery of fuel (11) to the burner (3) and combustion of the delivered fuel (11) in the burner (3). Further, a computing unit and a computer program product for carrying out such a method are proposed.

11 Claims, 3 Drawing Sheets

METHOD FOR OPERATING A FUEL-OPERATED BURNER

BACKGROUND OF THE INVENTION

The present invention relates to a method for operating a burner as well as a computing unit and a computer program for carrying out such a method.

To achieve legally prescribed emission limits, three-way catalytic converters (TWCs) can be used in order to enable a conversion of the relevant gaseous pollutants NOx, HC, and CO into harmless products such as N2, H2O, and CO2. In order for these catalytic reactions to proceed as intended, the temperature in the catalytic converter usually must exceed the so-called light-off temperature of typically 300-400° C. Once this temperature has been reached or exceeded, the catalytic convertor converts the relevant pollutants almost completely (so-called catalytic converter window).

In order to achieve this state as quickly as possible, so-called internal motor catalytic converter heat uptakes can be applied. The efficiency of the gasoline engine is thereby deteriorated by late ignition angles, and the exhaust temperature and enthalpy input into the catalytic converter is thus increased. With adapted injection strategies (e.g. multiple injections), the mixture processing can simultaneously be improved, and combustion stability can thus be ensured.

In addition to these engine-internal catalytic heating measures, external catalytic heating measures can also be used, for example, by means of electrically heatable catalytic converters or fuel-powered burners. Such external heating measures are described, for example, in DE 41 32 814 A1 and DE 195 04 208 A1.

To further reduce emissions compared to conventional operation with internal engine heating measures, in particular during cold runs, i.e. high loads on the engine in the cold state without an idling phase, burners as described in the aforementioned DE 41 32 814A1 or DE 22 19 371A1, for example, have proven to be a very effective measure for accelerating the TWC light-off.

SUMMARY OF THE INVENTION

According to the invention, a method for operating a burner as well as a computing unit and a computer program for carrying out said method having the features of the independent claims are proposed. Advantageous configurations are the subject-matter of the subclaims and the following description.

The invention creates a possibility for reducing emissions of hydrocarbons when using burners in the exhaust gas tract of an engine. In particular, fuel that collects in liquid form on the spark plug and housing wall of the burner burns from there in an undefined manner with high emissions. Wall depositing of fuel can be diminished if it is ignited immediately upon arrival at the spark plug. This minimizes the wall depositing of fuel and the resulting emissions. One aspect of the invention relates in particular to a synchronization of fuel metering and ignition in order to reduce the raw emission of the burner, in particular at startup.

In the context of the invention, in particular, the ignition apparatus, for example a spark plug, is operated in temporal synchronization with the fuel metering into the burner in order to ignite fuel upon reaching the ignition apparatus. To this end, the ignition apparatus can also ignite or already be burning at this time.

In order to generate an ignition spark, an ignition coil or its primary winding can be recharged (in the case of classical coil ignition) up to a predetermined minimum energy or a current value. The current increases during the charging time starting from zero. At a desired ignition time, the current flow through the primary winding is then interrupted, thereby inducing a voltage and raising it in a secondary winding. The secondary voltage (i.e. the voltage in the secondary winding) increases until the ignition device (e.g. a spark plug) breaks down. Then, the energy of the ignition coil discharges on the secondary side, in that the spark current is driven (i.e. the current flow across the spark path) over a certain burning or duration time depending on the primary current (i.e. the energy with which the ignition coil has been charged). The spark current decreases continuously until the spark goes out. Generally, this means an actuation of the ignition apparatus of the burner with an ignition apparatus actuation duration (charging time) starting at an ignition apparatus actuation start time.

Specifically, a method according to the present invention for operating a burner downstream of an engine and upstream of a catalytic converter comprises an actuation of a fuel metering device for delivering fuel to the burner starting at a meter time. The amount of fuel to be metered can in particular be adjusted by the actuation duration. Further, the method comprises an actuation of an ignition apparatus of the burner so that it ignites at an ignition time and subsequently burns for a burning duration, and a determining of the meter time and/or the ignition time such that fuel delivered to the burner at the meter time reaches the ignition apparatus at the ignition time or during the burning duration. Essential for avoiding undesired emissions is in particular that fuel cannot reach the ignition apparatus and be deposited there before the ignition time.

The fuel metered during the actuation duration is usually present in the burner spatially distributed in the form of a flowing fuel-air mixture cloud, wherein the fuel portions first metered (i.e. at the meter time) are at the very front and the fuel portions last metered (i.e. at the end of the actuation duration) are at the very rear, relative to the propagation direction (i.e. from the fuel metering device in the direction of the ignition apparatus). In the context of the invention, fuel metering and ignition are in particular matched to one another such that the ignition apparatus ignites no later than when the fuel-air mixture cloud arrives there.

Advantageously, the determining of the meter time and/or the ignition time is carried out such that fuel delivered to the burner at the meter time reaches the ignition apparatus at the ignition time or during the burning duration as a function of a distance between the fuel metering device and the ignition apparatus and/or as a function of a mean advancement speed of the fuel between the fuel metering device and the ignition apparatus. From these parameters, a necessary "time of flight" of the fuel-air mixture can be easily estimated.

The advancement speed is usually defined by an airflow in the burner, which is caused by a so-called secondary air pump, which is used in order to deliver air to the burner. For example, the advancement speed can depend on a pumping output.

In order to preheat the burner, in particular in the region of the ignition apparatus, prior to operation, and thus to achieve better ignition of fuel in operation, it can be provided that, before actuating the fuel metering device in order to deliver fuel to the burner, the ignition apparatus of the burner is already actuated starting at the meter time without igniting fuel, in particular without delivering fuel to the burner during this preheating phase.

Further preferably, an actuation of the ignition apparatus of the burner without fuel being ignited can also occur while fuel is being delivered to the burner, but before this fuel reaches the ignition apparatus.

By operating the ignition apparatus, the burning chamber of the burner is preheated so that fuel vaporizes more quickly in the vicinity of the ignition apparatus and forms an ignitable mixture with the delivered air. Overall, a faster burning start than in conventional applications is thus possible. During this preheating phase, one or more controls of the ignition apparatus can occur without igniting fuel, for example, in order to obtain a desired preheating temperature.

Another preferred option for preheating the burner, in particular the burning chamber wall, is that at least one fuel metering and ignition occur prior to switching on the airflow, i.e. actuating the secondary air pump. In other words, before actuating the secondary air pump in order to deliver air to the burner, at least one actuating of the fuel metering device for delivering fuel to the burner and at least one actuating of the ignition apparatus of the burner occurs.

If, in particular at the start of operation, the burner has not yet reached a sufficient temperature, the (in particular first-time) ignition apparatus actuation duration can also be extended in order to safely ignite the fuel-air mixture (i.e., in particular, ignition energy is increased by a long charge) in order to safely ignite the first injection through a particularly long ignition spark burning duration. In other words, a first actuation of the ignition apparatus of the burner occurs such that it ignites at the ignition time and then burns for the burning duration, with a longer ignition apparatus actuation duration than a later second actuation of the ignition apparatus of the burner or preferably than all later actuations during an operating cycle of the engine.

If a stable combustion then occurs in operation, the ignition can also be turned off entirely.

A computing unit according to the invention, e.g. a control unit of a vehicle, is configured, in particular in terms of program technology, so as to carry out a method according to the invention.

The implementation of a method according to the invention in the form of a computer program or computer program product with program code for carrying out all method steps is also advantageous as this results in particularly low costs, in particular if an executing control device is also used for further tasks and is therefore present in any event. Suitable data carriers for providing the computer program are, in particular, magnetic, optical, and electric storage media, such as hard disks, flash memory, EEPROMs, DVDs, and others. A download of a program via computer networks (Internet, Intranet, etc.) is also possible.

BRIEF DESCRIPTION OF THE DRAWINGS

Additional advantages and configurations of the invention result from the description and the enclosed drawing.

The invention is illustrated schematically in the drawing on the basis of embodiment examples and is described in detail in the following with reference to the drawings.

DETAILED DESCRIPTION

Figure 1:
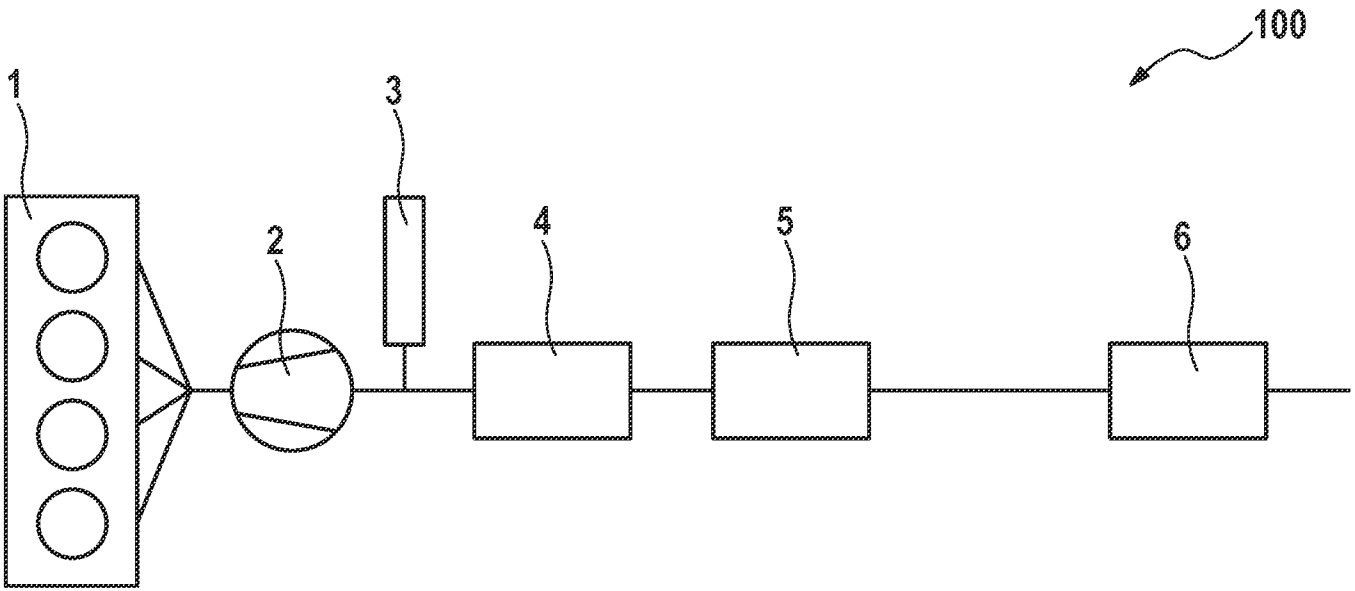
FIG. 1 schematically shows an arrangement with an engine, burner, and catalytic converter as can be used in advantageous configurations of the invention.

In FIG. 1, an arrangement with an engine, burner, and catalytic converter as can be used in advantageous configurations of the invention is shown schematically and bears the overall reference numeral 100.

In the illustrated example, a four-cylinder engine 1, a turbocharger 2 (optional), a burner 3, a three-way catalytic converter 4 (TWC), a gasoline particulate filter 5 (OPF), and a muffler 6 are arranged, wherein further components can also be provided within the scope of the invention that are not shown here. For example, several catalytic converters can also be provided, and the arrangement of the individual components with respect to one another, unless otherwise specified, need not necessarily correspond to the order shown. It is essential that the engine 1 is arranged on the remaining components and that the burner 3 is installed on the catalytic converter 4 in as close proximity to the latter as possible. In the case of several catalytic converters, the burner 3 is to be provided in the vicinity of the catalytic converter to be heated in order to achieve as efficient a delivery of heat as possible. In particular, several burners can then also be used.

As mentioned above, the catalytic converter 4 is configured so as to convert pollutants that can be contained in an exhaust gas of the engine 1 (but also of the burner 3). However, the catalytic converter 4 can only perform this task from a certain minimum temperature (so-called light-off temperature). As already explained, the burner 3 is therefore intended to heat the catalytic converter 4 as quickly as possible over the light-off temperature and thereby expel as few pollutant contents as possible from its own exhaust gas.

Figure 2:
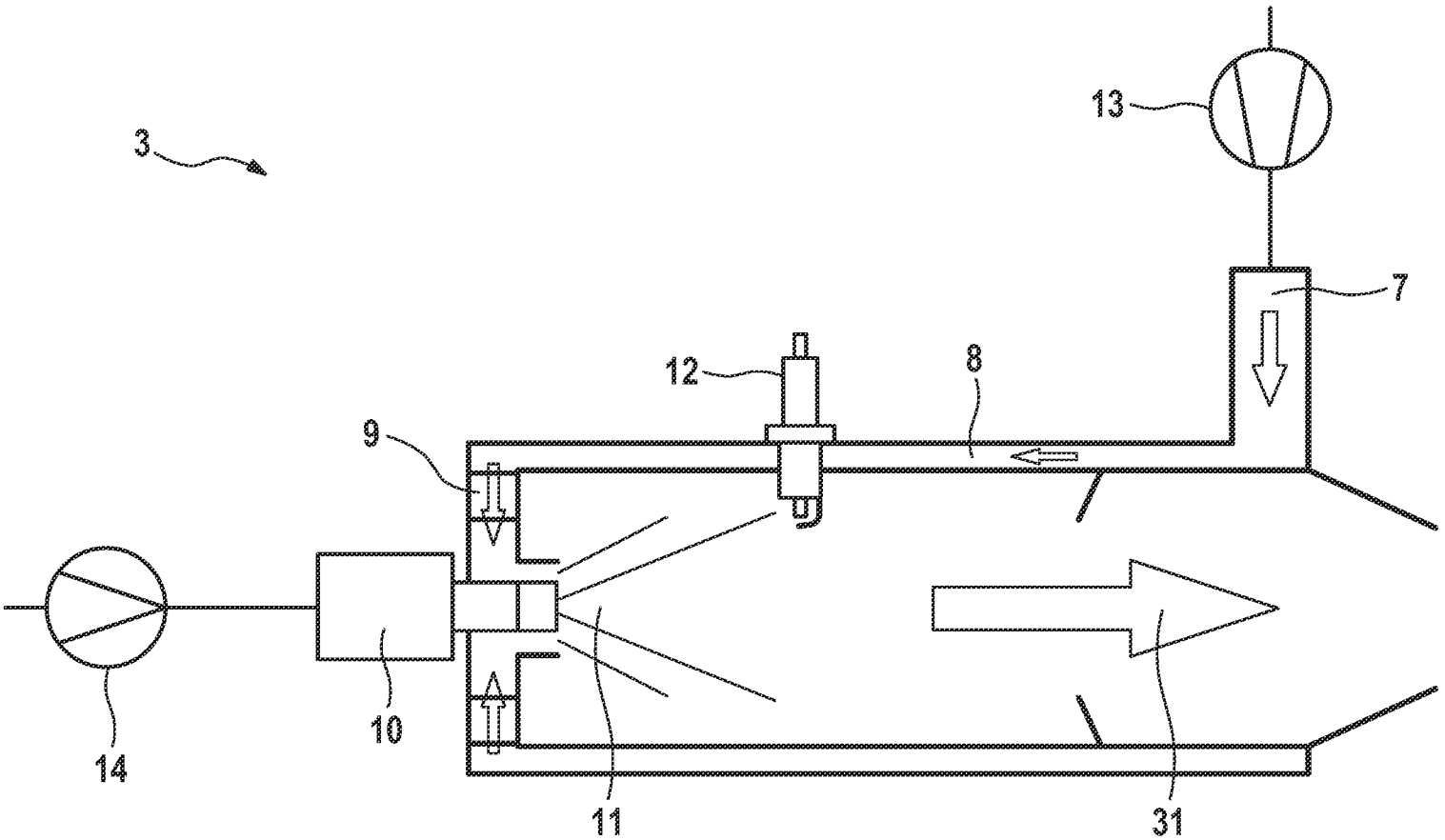
FIG. 2 shows a burner, as can be used in configurations of the present invention, in a schematic representation.

In FIG. 2, such a burner 3 is shown in greater detail schematically.

To operate the burner 3, for example, air 7 is conveyed via a secondary air pump 13 (SLP) into a burner jacket 8, is twisted via a swirl grid 9, and is guided to an injection valve 10 as a fuel metering device. Fuel 11 is delivered to the air 7 via the injection valve by means of a fuel pump (EKP) 14, which can also be considered part of the fuel metering device. Through the swirling and injection angles, a combustible fuel-air mixture is generated and guided to a spark plug 12 as the ignition apparatus. Here, the mixture is ignited and combusted in the combustion chamber. Hot burning gases or burning exhaust gas 31 are introduced into the exhaust system downstream of the engine 1 and upstream of the catalytic converter 4 to be heated.

In the context of a preferred embodiment of the present invention, fuel metering and ignition are now matched to one another such that fuel delivered to the burner at a meter time reaches the spark plug 12 at the ignition time or during the burning duration.

Figure 3:
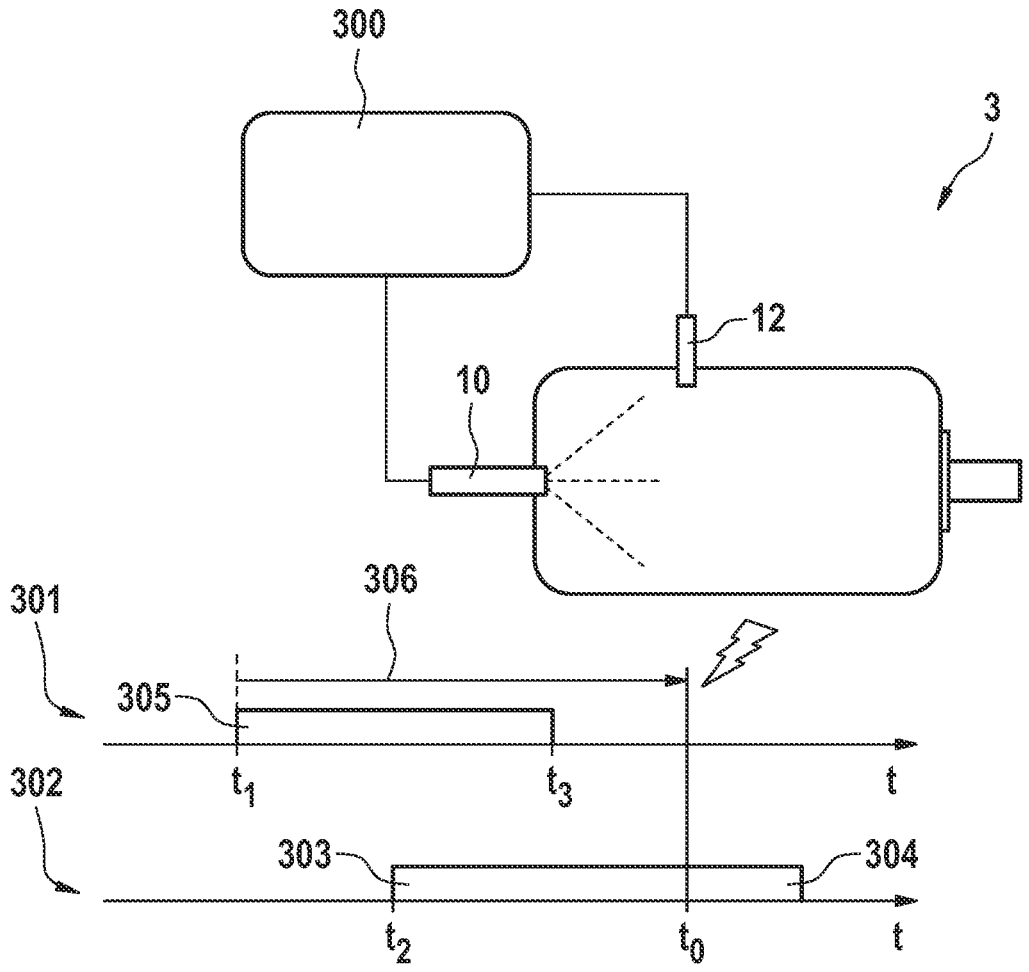
FIG. 3 schematically shows temporal profiles of fuel metering and ignition as can occur in advantageous configurations of a method according to the invention.

Referring now to FIG. 3, to actuate in particular the spark plug 12 and the injection valve 10, a computing unit 300, e.g. a so-called BCU (burner control unit) is provided, which is in particular configured so as to carry out a preferred embodiment of a method according to the invention. For explanation, an injection path 301 and an ignition path 302 are plotted against time t.

A desired ignition time is denoted with $t_0$. In particular, the spark plug 12 of the burner 3 is actuated so as to ignite at the ignition time $t_0$ in that the spark plug 12 or its ignition coil is actuated with an ignition apparatus actuation time 303 as the charging time starting at an ignition apparatus actuation start time $t_2$. After ignition at the ignition time $t_0$, the spark plug 12 burns over a burning duration 304.

According to a preferred embodiment of the invention, the fuel metering and ignition are now matched to one another such that the spark plug 12 ignites no later than when the fuel-air mixture cloud caused by the fuel metering arrives there. To this end, the injection valve 10 for delivering fuel 11 to the burner 3 is actuated, starting at a meter time $t_1$. Depending on the amount of fuel to be metered, the actuation takes an actuation duration 305 up to an actuation end time $t_3$. The temporal interval between the meter time $t_1$ and the ignition time $t_0$ is set to correspond to a "time of flight" 306 of the fuel from the injection valve 10 to the spark plug 12. The time of flight depends in particular on the specific geometric distance and the current mean advancement speed, which is essentially set by the airflow from the secondary air pump 13 or its speed.

As already explained above, in addition to this synchronous fuel metering and ignition, further measures can be taken in order to enable as safe and as emission-free operation of the burner 3 as possible. In particular, different preheating measures can be taken.

According to an advantageous embodiment, prior to the above-described ignition, the spark plug 12 of the burner 3 can be operated without fuel during a preheating period in order to heat the burning chamber of the burner 3 at least in the immediate vicinity of the spark plug 12, which facilitates or assists the ignition during an initial phase of the normal operating period.

In order to ensure a safe combustion, especially at the start of the injection, for example at the start (especially for the first injection), a longer ignition coil charging time for the spark plug can be provided and thus ultimately a safe ignition can be ensured.

Finally, once a safe combustion has finally been established in operation, the ignition can also be turned off entirely.

The invention claimed is:

1. A method for operating a burner (3) to introduce burning gases or burning exhaust gas into an exhaust system downstream of an engine (1) and upstream of a catalytic converter (4), the method comprising:

actuating a fuel metering device (10) to deliver fuel (11) to the burner (3) starting at a meter time ($t_1$), actuating an ignition apparatus (12) of the burner (3) such that it ignites at an ignition time ($t_0$) and subsequently burns for a burning duration (304), and determining the meter time ($t_1$) and/or the ignition time ($t_0$), such that fuel delivered to the burner (3) at the meter time ($t_1$) is not deposited in the burner prior to the ignition time but reaches the ignition apparatus at ignition time ($t_0$) or during the burning duration (304), wherein the ignition apparatus is a spark plug and wherein the burning duration is a time during which an energy of an ignition coil of the spark plug discharges to a secondary side of the spark plug.

2. The method according to claim 1, wherein the determining of the meter time ($t_1$) and/or the ignition time ($t_0$) is carried out such that fuel delivered to the burner (3) at the meter time ($t_1$) reaches the ignition apparatus (12) at the ignition time or during the burning duration (304) as a function of a distance between the fuel metering device (10) and the ignition apparatus (12) and/or as a function of a mean advancement speed of the fuel between the fuel metering device (10) and the ignition apparatus (12).

3. The method according to claim 1, comprising the following step before and/or during the actuation of the fuel metering device (10) for delivering fuel (11) to the burner (3), starting at the meter time ($t_1$):

actuating the ignition apparatus (12) of the burner (3) without igniting fuel.

4. The method according to claim 1, comprising the following step before the actuation of the fuel metering device (10) for delivering fuel (11) to the burner (3), starting at the meter time ($t_1$):

actuating a secondary air pump (13) for delivering air to the burner (3).

5. The method according to claim 4 comprising the following steps before the actuation of the secondary air pump (13) for delivering air to the burner (3):

actuating the fuel metering device (10) for delivering fuel (11) to the burner (3), actuating the ignition apparatus (12) of the burner (3).

6. The method according to claim 1, wherein the actuation of the ignition apparatus (12) of the burner (3) comprises an actuation of the ignition apparatus (12) with an ignition apparatus actuation duration (303) starting at an ignition apparatus actuating start time ($t_2$), such that it ignites at the ignition time ($t_0$).

7. The method according to claim 6, wherein a first actuation of the ignition apparatus (12) of the burner (3) is carried out with a longer ignition apparatus actuation duration (303) than a later second actuation of the ignition apparatus (12) of the burner (3), such that it ignites at the ignition time ($t_0$) and subsequently burns for the burning duration (304).

8. The method according to claim 1, wherein a spark plug is used as the ignition apparatus (12).

9. A system comprising:

a computing unit configured to:

actuate a fuel metering device (10) to deliver fuel (11) to a burner (3) starting at a meter time ($t_1$), the burner (3) configured to introduce burning gases or burning exhaust gas into an exhaust system downstream of an engine (1) and upstream of a catalytic converter (4), actuate an ignition apparatus (12) of the burner (3) such that it ignites at an ignition time ($t_0$) and subsequently burns for a burning duration (304), and determine the meter time ($t_1$) and/or the ignition time ($t_0$), such that fuel delivered to the burner (3) at the meter time ($t_1$) is not deposited in the burner prior to the ignition time but reaches the ignition apparatus at ignition time ($t_0$) or during the burning duration (304), wherein the ignition apparatus is a spark plug and wherein the burning duration is a time during which an energy of an ignition coil of the spark plug discharges to a secondary side of the spark plug.

10. The system of claim 9, further comprising the burner (3).

11. A non-transitory computer-readable medium including instructions executable by an electronic processor to perform a set of functions, the set of functions comprising:

actuating a fuel metering device (10) to deliver fuel (11) to the burner (3) starting at a meter time ($t_1$), actuating an ignition apparatus (12) of the burner (3) such that it ignites at an ignition time ($t_0$) and subsequently burns for a burning duration (304), and determining the meter time ($t_1$) and/or the ignition time ($t_0$), such that fuel delivered to the burner (3) at the meter time ($t_1$) is not deposited in the burner prior to the ignition time but reaches the ignition apparatus at ignition time ($t_0$) or during the burning duration (304), wherein the ignition apparatus is a spark plug and wherein the burning duration is a time during which an energy of an ignition coil of the spark plug discharges to a secondary side of the spark plug.

* * * * *